US006999694B2

(12) United States Patent
Takami

(10) Patent No.: US 6,999,694 B2
(45) Date of Patent: Feb. 14, 2006

(54) IMAGE FORMING APPARATUS HAVING A CONTROLLED BIAS APPLIED TO A CONDUCTIVE ELEMENT

(75) Inventor: Takeshi Takami, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/293,701

(22) Filed: Nov. 14, 2002

(65) Prior Publication Data

US 2003/0095808 A1 May 22, 2003

(30) Foreign Application Priority Data

Nov. 14, 2001 (JP) ..... P2001-348230

(51) Int. Cl.
*G03G 15/00* (2006.01)
*G03G 21/00* (2006.01)

(52) U.S. Cl. ..... 399/71; 399/98

(58) Field of Classification Search ..... 399/38, 399/71, 98, 99, 101, 159, 167, 228, 234, 399/302, 308, 343, 354
See application file for complete search history.

(56) References Cited

U.S. PATENT DOCUMENTS 5,671,476 A 9/1997 Ishiguro et al.
5,819,138 A * 10/1998 Hashizume ..... 399/98
5,822,649 A * 10/1998 Karashima et al. ..... 399/101 X
5,878,312 A * 3/1999 Hisada ..... 399/343 X
6,026,255 A * 2/2000 Kizaki et al. ..... 399/71 X
6,081,679 A * 6/2000 Yamane et al. ..... 399/71
6,215,967 B1 * 4/2001 Takeda et al. ..... 399/71 X

FOREIGN PATENT DOCUMENTS

| | | |
|---|---|---|
| GB | 2 297 721 A | 8/1995 |
| JP | A 60-107684 | 6/1985 |
| JP | 1-125456 U | 8/1989 |
| JP | 3-23468 A | 1/1991 |
| JP | 3-45555 U | 4/1991 |
| JP | 8-272273 A | 10/1996 |
| JP | A 08-328440 | 12/1996 |
| JP | 9-297461 A | 11/1997 |
| JP | 11-2946 A | 1/1999 |
| JP | 2000-292993 A | 10/2000 |
| JP | 2001-66959 A | 3/2001 |

* cited by examiner

*Primary Examiner*—Sandra L. Brase
(74) *Attorney, Agent, or Firm*—Oliff & Berridge, PLC

(57) ABSTRACT

In a laser printer, a photosensitive drum is rotated after the lapse of a period, necessary for a first cleaning bias applied to a cleaning roller to reach a set bias value after being turned on, for the start of an image forming operation. The first cleaning bias applied to the cleaning roller is turned off after a period of time has elapsed, required for a motor to stop rotating due to the inertia, after a motor signal is turned off and the image forming operation is finished.

18 Claims, 5 Drawing Sheets

IMAGE FORMING APPARATUS HAVING A CONTROLLED BIAS APPLIED TO A CONDUCTIVE ELEMENT

BACKGROUND OF THE INVENTION

1. Field of Invention

The invention relates to an electrophotographic type image forming apparatus, such as a laser printer.

2. Description of Related Art

An image forming apparatus of an electrophotographic type includes a developing roller that holds toner thereon, a photosensitive drum, on which an electrostatic latent image is formed, an image transfer roller that is used to transfer a visible toner image onto a sheet, and a cleaning roller that cleans a surface of the photosensitive drum.

The toner held on the developing roller is supplied onto the electrostatic latent image formed on the photosensitive drum to form a visible toner image. The visible toner image is then transferred onto a sheet by the image transfer roller, and thus, an image is formed on the sheet. However, some toner may remain on the photosensitive drum after the visible toner image is transferred onto the sheet.

As a bias is applied to the cleaning roller, the toner, which remains on the photosensitive drum, is electrically captured and removed by the cleaning roller. Thus, the surface of the photosensitive drum is cleaned. Therefore, an image forming operation can be performed in an excellent condition every time.

In a case where a motor for driving the photosensitive drum and the bias for the cleaning roller are simultaneously turned on when the image forming operation starts, the photosensitive drum starts rotating before the bias is applied to the cleaning roller. In this case, the toner, which has been captured and removed by the cleaning roller at the last image forming operation, adheres again to the photosensitive drum.

Further, in a case where the motor and the bias for the cleaning roller are simultaneously turned off when the image forming operation is completed, the photosensitive drum rotates for a while due to inertia, not stopping immediately. While the photosensitive drum rotates due to inertia, the toner, which has been captured and removed by the cleaning roller, again adheres to the photosensitive drum.

In particular, when a rotational speed of the motor is set to a high speed in order to speed up the image forming operation, the photosensitive drum is apt to rotate due to inertia. Therefore, the above-described problem is brought to the fore.

Further, the readhesion of the toner onto the photosensitive drum causes distortion of images, thereby causing a deterioration in image quality.

SUMMARY OF THE INVENTION

The invention addresses the above-identified problems by providing an image forming apparatus that can form high quality images. In particular, in one embodiment of the invention is an image forming apparatus, comprising an image holding element that holds an image formed by a developer, the image holding element being driven to move; an electric conductive element that contacts the image holding element; a biasing device that applies an electric bias to the electric conductive element to form an electric potential difference between the image holding element and the electric conductive element; and a controller that controls the biasing device such that the electric bias is applied to the electric conductive element before the image holding element is driven to move. Thus, the pre-applied bias retains the toner on the cleaning roller and the toner does not transfer to the photosensitive drum.

Further, the controller controls the image holding element to be driven when or after the electric bias becomes a predetermined value or when or after a predetermined time has elapsed after the application of the electric bias to ensure there is no transfer.

In another embodiment, the image forming apparatus comprises an image holding element that holds an image formed by a developer, the image holding element being driven to move; an electric conductive element that contacts the image holding element; a biasing device that applies an electric bias to the electric conductive element to form an electric potential difference between the image holding element and the electric conductive element; and a controller that controls the biasing device such that the electric bias applied to the electric conductive element is discontinued when or after the image holding element stops moving. Further, the controller controls the biasing device to discontinue applying the electric bias when or after a predetermined time has elapsed after the image holding element stops being driven.

The image forming apparatus further comprises a developer cartridge that contains a developing roller and the developer therein, wherein the developer cartridge is movable such that the developer roller separates from and contacts the photosensitive member. Additionally, the electric conductive element may be driven to move such that a moving velocity of the electric conductive element is different from a moving velocity of the image holding element.

In another embodiment, the controller may control the biasing device such that the electric bias is applied to the electric conductive element both before the image holding element is driven to move and after the image holding element stops moving.

BRIEF DESCRIPTION OF THE DRAWINGS

Exemplary embodiments of the invention will be described in detail with reference to the following figures wherein.

DETAILED DESCRIPTION OF PREFERRED EMBODIMENTS

Figure 1:
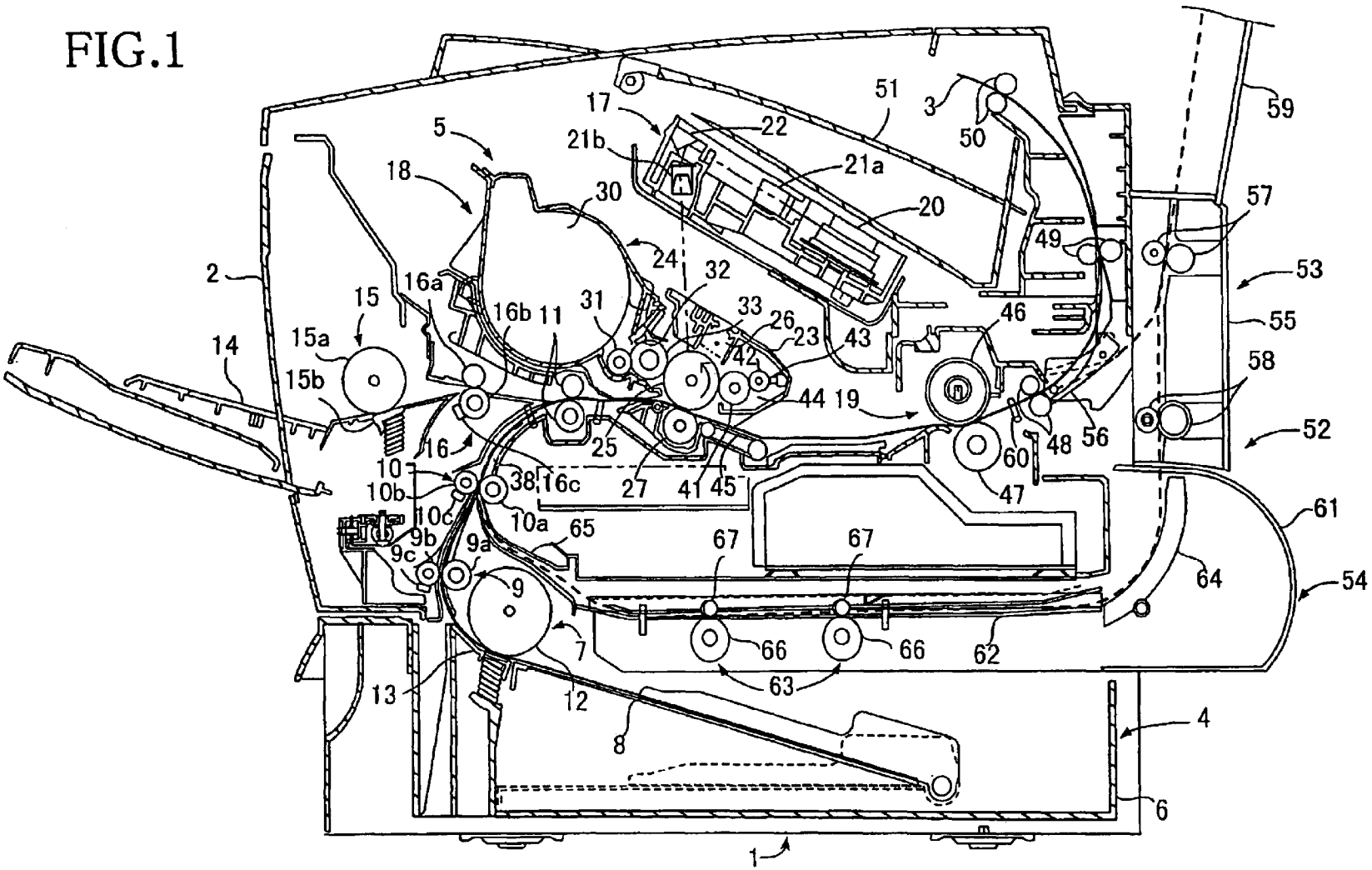
FIG. 1 is a cross-sectional view showing essential parts of a laser printer.

As shown in FIG. 1, a laser printer 1, which forms an image by using an electrophotographic process, includes a sheet feeding unit 4 that feeds a sheet 3 therefrom and an image forming unit 5 that forms an image onto the fed sheet 3. Hereinafter, the right and left of FIG. 1 are defined as the rear and front, respectively, and the defined directions are applicable to all the drawings.

The sheet feeding unit 4 is provided in the bottom of a casing 2 and includes a sheet tray 6 detachably attached to the casing 2, a sheet feeding mechanism 7 provided at one end of the sheet tray 6, a sheet pressing plate 8 provided in the sheet tray 6, first and second sheet conveying portions 9, 10 provided downstream of the sheet feeding mechanism 7 in a sheet feeding direction, and resist rollers 11 provided downstream of the first and second sheet conveying portions 9, 10 in the sheet feeding direction.

The sheet tray 6 has a box shape with an upper open structure. The sheet tray 6 can be attached to and detached from the bottom of the casing 2 in a horizontal direction and holds a stack of sheets 3 therein.

The sheet feeding mechanism 7 includes a pick-up roller 12. A separation pad 13 is provided opposite to the pick-up roller 12. The separation pad 13 is urged toward the pick-up roller 12 by a spring provided on the underside of the separation pad 13.

The sheet pressing plate 8 holds the stack of the sheets 3 on its surface. The sheet pressing plate 8 pivots on one end far from the pick-up roller 12, so that the other end of the sheet pressing plate 7, near the pick-up roller 12, can move up and down. A spring (not shown) is provided on the underside of the sheet pressing plate 8 to urge the sheet pressing plate 8 upward. As the number of sheets 3 stacked on the sheet pressing plate 8 increases, the sheet pressing plate 8 pivots downward, about the one end furthest from the pick-up roller 12, against the urging force from the spring. As the number of sheets 3 decreases, the sheet pressing plate 8 is pivoted upwardly about the one end by the urging force of the spring.

An uppermost sheet 3, of the stack on the sheet tray 6, is urged against the pick-up roller 12 by the urging force from the spring disposed on the underside of the sheet pressing plate 8. As the pick-up roller 12 rotates, the uppermost sheet 3 is picked up and fed between the pick-up roller 12 and the separation pad 13, the feed being one by one.

The first sheet conveying portion 9 is provided downstream of the sheet feeding mechanism 7 in the sheet feeding direction. The first sheet conveying portion 9 includes a first conveying roller 9*a* for conveying the sheet 3, a first paper dust removing roller 9*b*, and a first sponge member 9*c*. The first paper dust removing roller 9*b* is disposed so as to face the first conveying roller 9*a* and has a slightly wider width than the separation pad 13. The first sponge member 9*c* is disposed below the first paper dust removing roller 9*b* so as to face the first paper dust removing roller 9*b*.

The sheet 3 is pinched and conveyed by the first conveying roller 9*a* and the first paper dust removing roller 9*b*. Paper dust, which is generated by friction between the separation pad 13 and the sheet 3, is removed from the sheet 3 by the first paper dust removing roller 9*b*. Then, the paper dust, which adheres to the first paper dust removing roller 9*b*, is removed by the first sponge member 9*c*.

The second sheet conveying portion 10 is provided downstream of the first sheet conveying portion 9 in the sheet feeding direction. The second sheet conveying portion 10 includes a second conveying roller 10*a* for conveying the sheet 3, a second paper dust removing roller 10*b*, and a second sponge member 10*c*. The second paper dust removing roller 10*b* is disposed so as to face the second conveying roller 10*b* and has a slightly greater width than the sheet 3. The second sponge member 10*c* is disposed below the second paper dust removing roller 10*b* so as to face the second paper dust removing roller 10*b*.

The sheet 3 conveyed from the first sheet conveying portion 9 is pinched and conveyed by the second conveying roller 10*a* and the second paper dust removing roller 10*b*. Paper dust, which was generated at the cutting of the sheets 3 and entirely adheres to the sheets 3 (i.e. paper dust, which has adhered to the sheet 3 before the sheet 3 is loaded into the sheet tray 6), is removed from the sheet 3 by the second paper dust removing roller 10*b*. Then, the paper dust, which adheres to the second paper dust removing roller 10*b*, is removed by the second sponge member 10*c*.

Accordingly, the paper dust, which is generated by the friction between the sheet 3 and the separation pad 13 and that which adhered to the sheet 3 before the sheet 3 is loaded in the sheet tray 6, is excellently removed from the sheet 3 at the first and second sheet conveying portions 9, 10.

The resist rollers 11 include a pair of rollers that correct deviation of the sheet 3 fed from the second sheet conveying portion 10 and then feed the sheet 3 to the image forming unit 5.

As shown in FIG. 1, the sheet feeding unit 4 further includes a multi-purpose tray 14 for stacking thereon a stack of random size sheets 3, a multi-purpose sheet feeding mechanism 15 for feeding the sheets 3 on the multi-purpose tray 14, and a multi-purpose sheet conveying portion 16.

The multi-purpose sheet feeding mechanism 15 includes a multi-purpose pick-up roller 15*a* and a multi-purpose separation pad 15*b*, which are disposed to face each other.

The multi-purpose separation pad 15*b* is urged against the multi-purpose pick-up roller 15*a* by a urging force from a spring provided on the underside of the multi-purpose separation pad 15*a*. Upon rotation of the multi-purpose pick-up roller 15*a*, an uppermost sheet 3 on the stack in the multi-purpose tray 14 is picked by the multi-purpose pick-up roller 15*a* and the multi-purpose separation pad 15*b*. Thus, the sheet 3 is separated from the stack and fed to the downstream units one sheet after another.

The multi-purpose sheet conveying portion 16 is provided downstream of the multi-purpose sheet feeding mechanism 15 and upstream of the resist rollers 11, in the sheet feeding direction. The multi-purpose sheet conveying portion 16 includes a multi-purpose conveying roller 16*a* for conveying the sheet 3, a multi-purpose paper dust removing roller 16*b*, and a multi-purpose sponge member 16*c*. The multi-purpose paper dust removing roller 16*b* is disposed so as to face the multi-purpose conveying roller 16*a*. The multi-purpose sponge member 16*c* is disposed below the multi-purpose paper dust removing roller 16*b* so as to face the multi-purpose paper dust removing roller 16*b*.

The sheet 3 fed from the multi-purpose sheet feeding mechanism 15 is pinched and conveyed by the multi-purpose conveying roller 16*a* and the multi-purpose paper dust removing roller 16*b*. At that time, paper dust, which adheres to the sheet 3, is removed by the multi-purpose paper dust removing roller 16*b*. The paper dust, which adheres to the multi-purpose paper dust removing roller 16*b*, is then removed by the multi-purpose sponge member 16*c*.

After that, the sheet 3 is conveyed from the multi-purpose sheet conveying portion 16 to the resist rollers 11. The deviation of the sheet 3 is corrected by the resist rollers 11 and then conveyed to the image forming unit 5.

The image forming unit 5 includes a scanner unit 17, a process unit 18, and a fixing unit 19.

The scanner unit 17 is fixed at the upper portion of the casing 2, and includes a laser emitting portion (not shown), a polygon mirror 20 that is driven to spin, lenses 21*a*, 21*b*, and a reflector 22. A laser beam, which is emitted from the laser emitting portion, is modulated based on image data. As indicated by a double-dashed chain line shown in FIG. 1, the laser beam passes through or reflects off the polygon mirror 20, the lens 21*a*, the reflector 22, and the lens 21*b* in order. The laser beam scans a surface of a photosensitive drum 25.

The process unit 18 is provided below the scanner unit 17. The process unit 18 includes a drum cartridge 23, a developing cartridge 24, the photosensitive drum 25, a charging device 26, and an image transfer roller 27. The drum cartridge 23 is detachably attached with respect to the casing 2. The photosensitive drum 25, the charging device 26, and the image transfer roller 27 are integrally provided in the drum cartridge 23.

The developing cartridge 24 is detachably attached with respect to the drum cartridge 23, and includes a toner box 30, a toner supply roller 31, a layer thickness-regulating blade 32, and a developing roller 33.

The toner box 30 accommodates a positively charging non-magnetic single component toner as a developing agent. The toner to be used is a polymerized toner that is obtained by copolymerizing monomers, such as styrene-based monomers, for example, styrene, and polymerizable monomers, such as acrylic-based monomers, for example, acrylic acid, alkyl (C1–C4) acrylate, and alkyl (C1–C4) methacrylate, using a known polymerization method, such as a suspension polymerization method.

The toner particle size is approximately 6 to 10 mm. The polymerized toner particles are spherical in shape, having excellent fluidity. Thus, a high quality image can be formed with a high resolution. The toner is mixed with a coloring material, such as carbon black, and wax, as well as silica as an external additive, to improve the fluidity of the toner.

The toner stored in the toner box 30 is agitated by an agitator (not shown) to be supplied from the toner box 30 to the toner supply roller 31.

The toner supply roller 31 is provided at the side of the toner box 30 to rotate in a counterclockwise direction. The developing roller 33, facing the toner supply roller 31, is provided to rotate in a clockwise direction. The toner supply roller 31 and the developing roller 33 are in contact with each other while both rollers 31, 33 apply just the right amount of pressure to each other. The toner supply roller 31 includes a metal shaft covered with a conductive foam material.

The developing roller 33 includes a metal shaft covered with a conductive elastic member. More specifically, the elastic member of the developing roller 33 is formed of conductive urethane rubber or silicone rubber including fine carbon particles. The elastic member is coated with urethane rubber or silicone rubber including fluorine. A predetermined development bias is applied to the developing roller 33.

The layer thickness-regulating blade 32 is disposed near and slightly above the developing roller 33, so as to oppose developing roller 33, and extends along an axial direction of the developing roller 33. The layer thickness-regulating blade 32 includes a metal leaf spring member and an urging member provided at a free end of the leaf spring member.

The leaf spring member is fixed to the developing cartridge 24. The urging member is urged against the surface of the developing roller 33 by the elastic force from the leaf spring member. The urging member has a semicircular shape in cross section and is made of insulating silicone rubber.

The toner is supplied from the toner box 30 to the developing roller 33 by the rotation of the toner supply roller 31. The toner is positively charged by friction caused between the toner supply roller 31 and the developing roller 33 when passing therebetween.

The toner supplied to the development roller 33 then enters between the urging portion of the layer thickness-regulating blade 32 and the developing roller 33 by the rotation of the developing roller 33 and is further charged by friction therebetween. Thus, the toner held by the developing roller 33 has a certain thickness.

Figure 3:
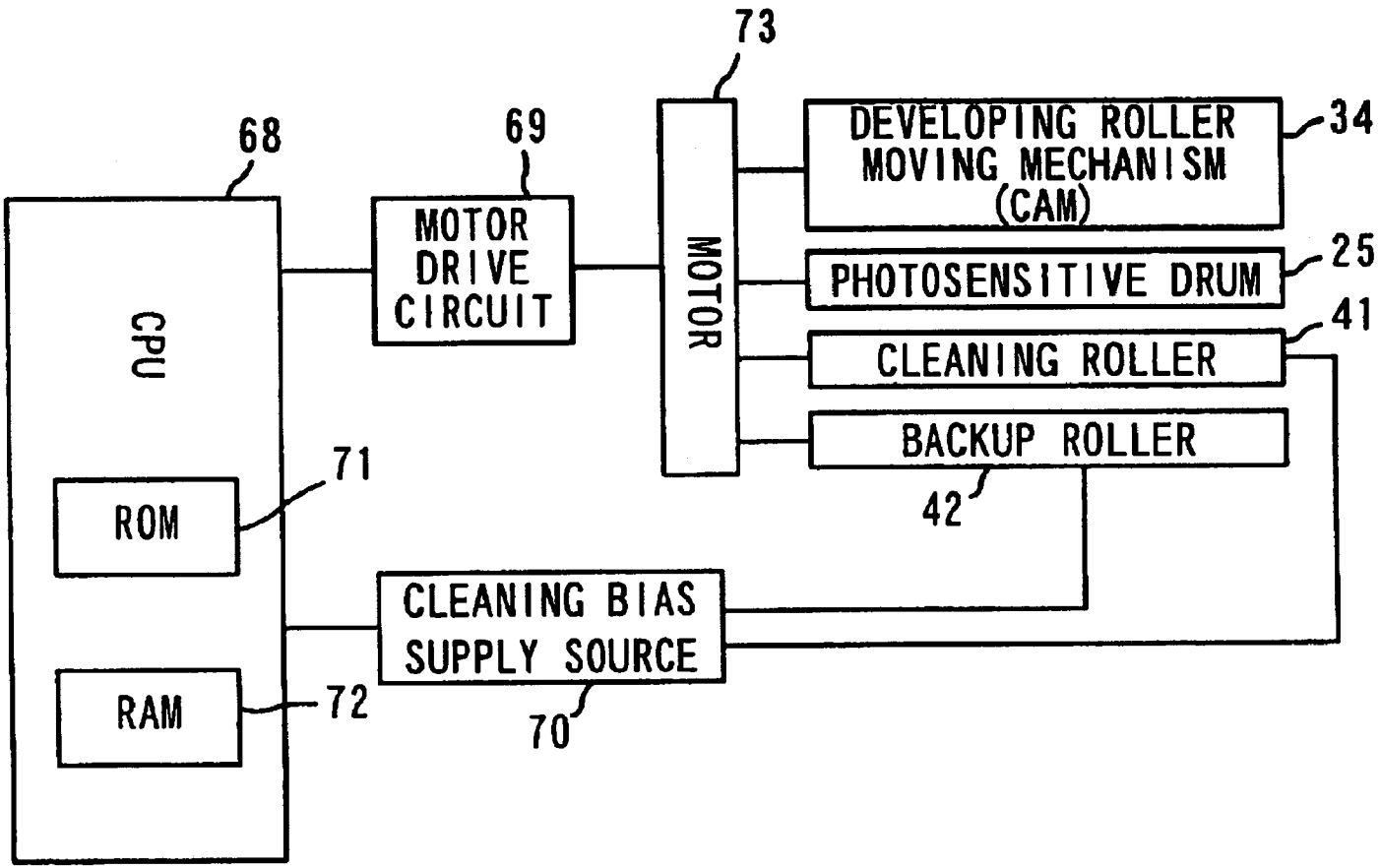
FIG. 3 is a block diagram showing a control system for controlling a cleaning operation.

The photosensitive drum 25 is provided at the side of, and faces, the developing roller 33 (FIG. 1) so as to rotate in the counterclockwise direction. The photosensitive drum 25 is rotated by a motor 73 (FIG. 3). The photosensitive drum 25 is made of an aluminum cylindrical member coated with a positively charged photosensitive layer made of polycarbonate. The cylindrical member of the photosensitive drum 25 is The charging device 26 is provided above the photosensitive drum 25 at a predetermined distance therefrom so as not to contact the photosensitive drum 25. The charging device 26 is a scorotron charging device that generates corona discharge using tungsten wires and uniformly and positively charges the surface of the photosensitive drum 25.

The surface of the photosensitive drum 25 is uniformly positively charged (approximately 900 V) by the charging device 26, and then subjected to exposure to a laser beam emitted from the scanner unit 17. The potential of the portion, which is exposed to the laser beam, becomes approximately 100 V. Thus, an electrostatic latent image is formed on the surface of the photosensitive drum 25 based on image data. The electrostatic latent image is a portion which was exposed to a laser beam and has a potential lower than the surrounding portion.

The positively charged toner held by the developing roller 33 adheres to the electrostatic latent image formed on the photosensitive drum 25 when the toner faces and contacts the latent image formed on the photosensitive drum 25. Thus, the electrostatic latent image is visualized.

The developing roller 33 contacts the photosensitive drum 25 only when a developing operation is performed, and is separated from the photosensitive drum 25 when there is no developing operation by a developing roller moving mechanism 34.

The developing roller moving mechanism 34 includes an engaging portion 35, an urging plate 36 provided to the casing 2, an urging spring 37, a swing plate 38 and a cam 39. The engaging portion 35 protrudes from a housing of the developing cartridge 24 in the horizontal direction.

The urging plate 36 is swingably supported at its lower end portion. One end of the urging spring 37 is connected to an upper end portion of the urging plate 36. The other end of the urging spring 37 is fixed to the casing 2. The upper end portion of the urging plate 36 is urged toward the photosensitive drum 25 by an urging force from the urging spring 37.

The swing plate 38 is swingably supported at its middle portion. The lower end of the swing plate 38 is in contact with the cam 39, which includes a thin-walled portion 39*a* and a thick-walled portion 39*b*. When the thin-walled portion 39*a* of the cam 39 contacts the lower end portion of the swing plate 38 by the rotation of the cam 39, the upper end portion of the swing plate 38 swings toward the photosensitive drum 25. When the thick-walled portion 39*b* of the cam 39 contacts the lower end portion of the swing plate 38, the upper end portion of the swing plate 38 swings in the opposite direction, i.e., away from the photo-sensitive drum 25.

When the developing cartridge 24 is attached to the drum cartridge 23, the engaging portion 35 of the developing cartridge 24 is inserted between the urging plate 36 and the swing plate 38. For the developing operation, the cam 39 is rotated by the motor 73 (FIG. 3) to contact the thin-walled portion 39*a* of the cam 39 with the lower end portion of the swing plate 38. Then, the engaging portion 35, pinched between the urging plate 36 and the swing plate 38, is moved toward the photosensitive drum 25 by the urging force from the urging spring 37, so that the developing roller 33 contacts the photosensitive drum 25.

When the developing operation is finished, the cam 39 is rotated to make the thick-walled portion 39*b* of the cam 39 contact the lower end portion of the swing plate 38. Then, the upper end portion of the swing plate 38 swings in the opposite direction against the urging force from the urging spring 37, and the engaging portion 35 pinched between the urging plate 36 and the swing plate 38 is moved in a direction to separate from the photosensitive drum 25. Thus, the developing roller 33 is separated from the photosensitive drum 25. While the developing operation is not performed, the developing cartridge 24 is kept in this state.

The image transfer roller 27 is provided to oppose to the photosensitive drum 25. The image transfer roller 27 is supported, below the photosensitive drum 25, by the drum cartridge 23, so as to rotate in the clockwise direction. The image transfer roller 27 is a metal shaft covered with a conductive rubber material. A transfer bias between −1 KV and −2 KV is applied to the image transfer roller 27.

The visible toner image held on the surface of the photosensitive drum 25 is transferred onto the sheet 3 by the action of the transfer bias applied to the transfer roller 27, as the sheet 3 passes between the photosensitive drum 25 and the image transfer roller 27. As shown in FIG. 1, the sheet, on to which the image is transferred, is then conveyed to the fixing unit 19 via a conveyor belt 45.

The drum cartridge 23 further includes a cleaning unit 40 that removes contaminants, such as toner and paper dust, which remain on the surface of the photosensitive drum 25 after the visible toner image is transferred onto the sheet 3.

Figure 2:
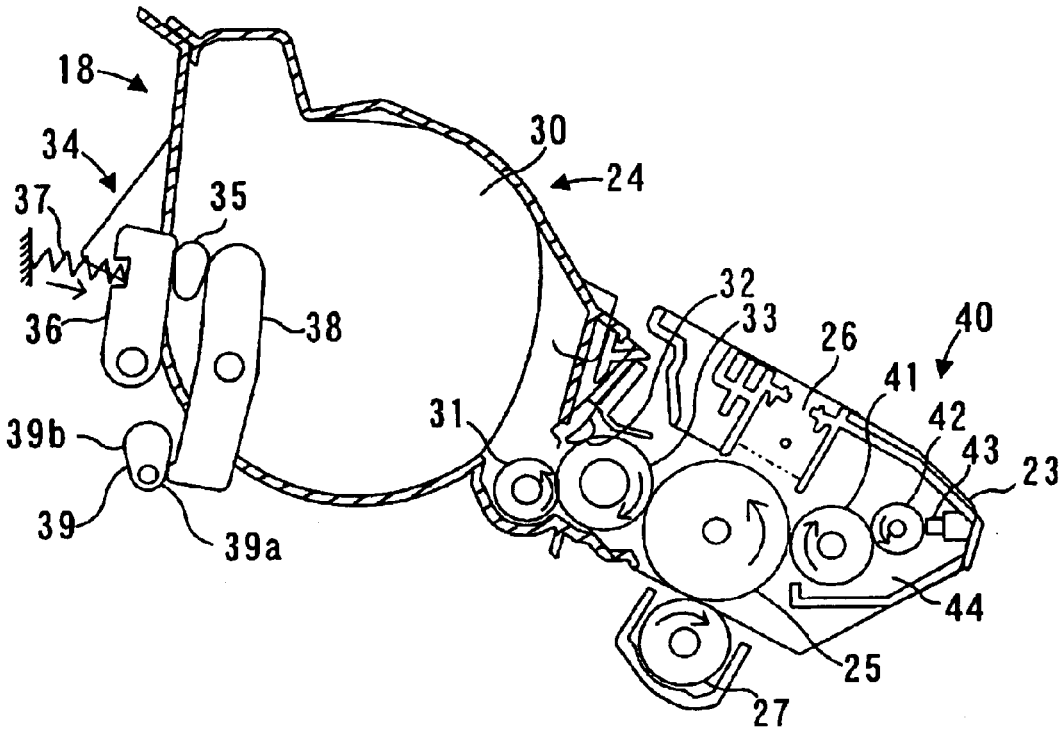
FIG. 2 is a cross-sectional view showing essential parts of a process unit of the laser printer of FIG. 1.

As shown in FIG. 2, the cleaning unit 40 includes a conductive cleaning roller 41, a backup roller 42, a wiping sponge 43, and a paper dust storage portion 44.

The cleaning roller 41 is provided so as to be opposite to the developing roller 33, sandwiching the photosensitive drum 25 therebetween. The cleaning roller 41 is disposed downstream of the image transfer roller 27 and upstream of the charging device 26, in the direction of rotation of the photosensitive drum 25, so as to contact the photosensitive drum 25.

The cleaning roller 41 includes a roller shaft made of an elastic foam member, such as silicon rubber, and supported by the drum cartridge 23 so as to rotate in the clockwise direction. The cleaning roller 41 is rotated by the motor 73 (FIG. 3) while a predetermined peripheral speed difference is maintained with respect to the rotational speed of the photosensitive drum 25. More specifically, the cleaning roller 41 rotates at a speed half as fast as the photosensitive drum 25.

A cleaning bias is applied to the cleaning roller 41 by a cleaning bias supply source 70 (described later). As the cleaning bias is applied to the cleaning roller 41, contaminants, such as toner remaining on the surface of the photosensitive drum 25 and paper dust transferred from the sheet 3 after the transfer of the image, are electrically captured and removed by the cleaning roller 41. The cleaning roller 41 can be applied with a first cleaning bias of approximately −200 V and a second cleaning bias of approximately +700 V.

The first cleaning bias is applied to the cleaning roller 41 during the image forming operation. When the first cleaning bias is applied to the cleaning roller 41, a surface potential difference between the cleaning roller 41 and the photosensitive drum 25, after the transfer of the image, becomes approximately between 550 V and 600 V, which is lower than a discharge starting voltage of the photosensitive drum 25. Therefore, the toner, which adheres to the surface of the photosensitive drum 25, is captured and removed by the cleaning roller 41.

The second cleaning bias is applied to the cleaning roller 41 while the image forming operation is not performed. When the second cleaning bias is applied to the cleaning roller 41, the toner, which has been captured and removed by the cleaning roller 41, is fed back to the photosensitive drum 25. The toner, which has been fed back to the photosensitive drum 25, is then collected by the developing roller 33, when the toner on the photosensitive drum 25 faces and contacts the developing roller 33 by the rotation of the photosensitive drum 25.

The total internal impedance of the cleaning roller 41 and the cleaning bias supply source 70 is $10^4$ Ω up to but not including $10^8$ Ω.

The backup roller 42 is provided so as to face the photosensitive drum 25 while contacting the cleaning roller 41 and sandwiching the cleaning roller 41 therebetween. The backup roller 42 is a metal shaft, which is supported by the drum cartridge 23 so as to be rotated by the motor 37 (FIG. 3) in the counterclockwise direction at the same speed as the cleaning roller 41.

The backup roller 42 is applied with a first cleaning bias of approximately −100 V while the image forming operation is performed, and a second cleaning bias of approximately +800 V while the image forming operation is not being performed, by the cleaning bias supply source 70 (FIG. 3).

The wiping sponge 43 is disposed so as to face and be urged toward the cleaning roller 41, sandwiching the backup roller 42 therebetween. The wiping sponge 43 is made from a foam member, such as urethane foam, and wipes and removes paper dust which adheres to the surface of the backup roller 42. The paper dust storage portion 44 is a space provided under the wiping sponge 43, in the drum cartridge 23.

After the visible toner image is transferred onto the sheet 3 from the photosensitive drum 25, contaminants, such as toner, which remain on the surface of the photosensitive drum 25 without transfer onto the sheet 3, and paper dust, which adheres to the photosensitive drum 25 from the sheet 3, exist on the photosensitive drum 25.

At the image forming operation, the remaining toner is captured and removed by the cleaning roller 41, due to a potential difference caused between the photosensitive drum 25 and the cleaning roller 41 by the first cleaning bias applied to the cleaning roller 41, when the toner remaining on the photosensitive drum 25 faces and contacts the cleaning roller 41.

The toner, which is captured and removed by the cleaning roller 41, is electrically held by the cleaning roller 41 while the image forming operation is performed. When the image forming operation is not performed, the cleaning roller 41 and the backup roller 42 are applied with the second cleaning bias having a polarity reverse to the first cleaning bias, at a predetermined timing.

By doing so, the toner, which adheres to the cleaning roller 41, is fed back to the photosensitive drum 25. The toner, which adheres to the photosensitive drum 25, is then collected by the developing roller 33, due to a potential difference between the developing roller 33 and the photosensitive drum 25, when the toner formerly held by the cleaning roller 41 is carried by the rotation of the photosensitive drum 25 face and contact the developing roller 33. The toner collected by the developing roller 33 is reused at the next developing operation.

When the second cleaning bias is applied to the cleaning roller 41, paper dust, which adheres to the surface of the photosensitive drum 25, is captured and removed by the cleaning roller 41, due to a potential difference caused between the photosensitive drum 25 and the cleaning roller 41 by the second cleaning bias applied to the cleaning roller 41.

The paper dust, which is captured and removed by the cleaning roller 41, is then captured and removed by the backup roller 42, due to a potential difference caused between the cleaning roller 41 and the backup roller 42 by the second cleaning bias applied to the backup roller 42.

The paper dust, which is captured and removed by the backup roller 42, is removed, by the wiping sponge 43, from the backup roller 42 facing and contacting the wiping sponge 43. The removed paper dust is stored in the paper dust storage portion 44.

As shown in FIG. 1, the fixing unit 19 is provided downstream of the process unit 18 in the sheet feeding direction. The fixing unit 19 includes a heat roller 46, an urging roller 47 that urges the heat roller 46, and a pair of conveying rollers 48 that are provided downstream of the heat roller 46 and the urging roller 47 in the sheet feeding direction.

The heat roller 46 includes a cylindrical member made of metal, such as aluminum, coated with silicone rubber. The heat roller 46 has a halogen lamp therein, as a heating element.

When the sheet 3 passes between the heat roller 46 and the urging roller 47, the toner transferred onto the sheet 3 is melted by heat from the heat roller 46, and fixed on the sheet 3 by an urging force from the urging roller 47. The sheet 3, on which the image is fixed by the fixing unit 19, is fed to discharge rollers 49, 50 by conveying rollers 48. Then, the sheet 3 is ejected onto an output tray 51 provided at the top of the casing 2, by the discharge rollers 50.

In the laser printer 1, a sheet recirculation unit 52 is provided for forming images on both surfaces of the sheet 3. The recirculation unit 52 includes a sheet reverse mechanism 53 and a recirculation tray 54 integrally therewith. The recirculation unit 52 is positioned at a rear wall of the casing 2 in such a manner that the sheet reverse mechanism 53 is attached beside the rear wall, and the recirculation tray 54 is detachably insertedly assembled into the rear wall at a position above the sheet feeding unit 4.

The sheet reverse mechanism 53 has a casing 55 having a rectangular cross-section and attached to the rear wall of the casing 2. In the casing 55, a flapper 56, reverse rollers 57 and recirculation rollers 58 are provided. Further, a reverse guide plate 59 extends upwardly from an upper end portion of the casing 55.

The flapper 56 is pivotably provided at the rear portion of the casing 2 and is positioned at a downstream side of the conveying rollers 48. The flapper 56 is pivotally moved upon energization or de-energization of a solenoid (not shown) for switching a feeding direction of the one-sided image carrying sheet 3 fed by the conveying rollers 48 either to the downstream discharge rollers 49, as shown by a solid line, or to the reverse rollers 57, as shown by a dashed line.

The reverse rollers 57 include a pair of rollers and are positioned downstream of the flapper 56 and at an upper portion of the casing 55. The rotational direction of the reverse rollers 57 is changeable between normal (forward) and reverse directions. The reverse rollers 57 are first rotated in the normal direction to direct the sheet 3 toward the reverse guide plate 59, and then rotated in the reverse direction to transport the sheet 3 in the reverse direction.

The recirculation rollers 58 are positioned downstream of the reverse rollers 57 and are positioned immediately therebelow in the casing 55. The recirculation rollers 57 include a pair of rollers to direct the sheet 3 reversely driven by the reverse rollers 57 toward the recirculation tray 54. The reverse guide plate 59 comprises a plate like member extending upwardly from the upper end of the casing 55 for guiding travel of the sheet 3 fed by the reverse rollers 57.

For printing an image on a back surface of the sheet 3 whose front surface has been formed with an image, in the sheet reverse mechanism 53, the flapper 56 is switched to a position allowing the sheet 3 to be fed toward the reverse roller pair 57. Thus, the sheet 3, whose front surface has been formed with an image, is received in the sheet reverse mechanism 53. After the sheet 3 reaches the reverse rollers 57, the reverse rollers 57 are rotated in a normal direction for temporarily discharging the paper upwardly along the reverse guide plate 59. When a major part of the sheet 3 is fed out of the casing 55 and a trailing end portion of the sheet 3 is nipped between the reverse roller pair 57, the normal rotation of the reverse roller pair 57 is stopped. Then, the reverse roller pair 57 are reversely rotated to feed the sheet 3 downwardly toward the recirculation roller pair 58. A sheet sensor 60 is provided downstream of the fixing unit 19 for detecting the sheet 3. A reverse timing for changing the rotating direction of the reverse rollers 57 from the normal rotation to the reverse rotation is controlled such that the reverse timing occurs after a predetermined period starting from a detection timing at which the sheet sensor 60 detects the trailing edge of the sheet 3. Further, the flapper 56 is switched to its original posture, i.e., a posture allowing the sheet 3 to be fed to the downstream discharge rollers 49 from the conveying rollers 48 upon completion of feeding of the sheet to the reverse rollers 57.

Then, the sheet 3 reversely fed by the recirculation roller pair 58 is delivered to the recirculation tray 54 by the recirculation roller pair 58. The recirculation tray 54 has a sheet receiving portion 61, a tray 62 and diagonal feed rollers 63.

The sheet receiving portion 61 is externally attached to the casing 2 at a position below the sheet reverse mechanism 53, and has an arcuate sheet guide member 64. The sheet 3, which is substantially vertically downwardly oriented from the recirculation roller pair 58, can be oriented in a substantially horizontal direction along the curvature of the sheet guide member 64 toward the tray 62.

The tray 62 has a rectangular plate-like shape, and is oriented in a substantially horizontal direction above the sheet tray 6. An upstream end of the tray 62 is connected to the sheet guide member 64, and a downstream end of the tray 62 is connected to a recirculation path guide 65 in order to guide the sheet 3 from the tray 62 to the second sheet conveying portion 10.

At a sheet path on the tray 62, two diagonal feed rollers 63 are positioned to be spaced away from each other in the sheet feeding direction. These diagonal feed rollers 63 are adapted to feed the sheet 3 in a direction for permitting the sheet to be in abutment with a reference plate (not shown).

The reference plate is positioned at one widthwise edge area of the tray 62. Each diagonal feed roller 63 includes a diagonal feed drive roller 66, whose rotation axis extends substantially perpendicular to the sheet feeding direction, and a diagonal feed driven roller 67 in nipping relation to the diagonal feed drive roller 66. A rotation axis of the diagonal feed driven roller 67 extends in a direction displaced from the direction perpendicular to the sheet feeding direction, i.e., extends in a slanting direction to allow the sheet 3 to be brought into abutment with the reference plate.

The sheet 3 delivered from the sheet receiving portion 61 to the tray 62 moves toward the image forming unit 5, with the sheet having been turned upside down, through the recirculation path guide 65 while one widthwise edge of the sheet 3 is moved in a sliding abutting relationship to the reference plate by the drive of the diagonal feed rollers 63. At the image forming unit 5, the back surface of the sheet 3 confronts the photosensitive drum 25 to enable transference of a toner image to the back surface from the photosensitive drum 25. The toner image is then fixed at the fixing unit 19, and sheet 3 is then discharged onto the output tray 51.

In the laser printer 1 of the embodiment, the first cleaning bias for the cleaning roller 41 is turned on before the photosensitive drum 25 is driven, and is turned off when or after the rotation of photosensitive drum 25 is stopped.

As shown in FIG. 3, a CPU 68, which functions as a controller, is connected with a motor drive circuit 69, that controls the motor 73, and the cleaning bias supply source 70. The CPU 68 includes a ROM 71 and a RAM 72 and controls various elements of the printer. The ROM 71 stores a drive control program for executing the image forming operation. The RAM 72 temporarily stores numerical values for controlling the various elements.

The motor drive circuit 69 is connected with the motor 73. The motor 73 is connected with various members and elements of the printer in addition to the cam 39 of the developer moving mechanism 34, the photosensitive drum 25, the cleaning roller 41, and the backup roller 42, via a gear train (not shown). A DC servo motor is used as the motor 73.

The driving and stopping of the motor 73 is controlled by the motor drive circuit 69, which is controlled in accordance with the drive control program stored in the ROM 71. That is, the driving and stopping of the developing moving mechanism 34 (cam 39), the photosensitive drum 25, the cleaning roller 41, and the backup roller 42 are controlled by the drive control program.

An output of the cleaning bias supply source 70 is connected with roller shafts of the cleaning roller 41 and the backup roller 42. By controlling the cleaning bias supply source 70 in accordance with the drive control program stored in the ROM 71, the on and off of the first and second cleaning biases to the cleaning roller 41 and the backup roller 42 are controlled.

Figure 4:
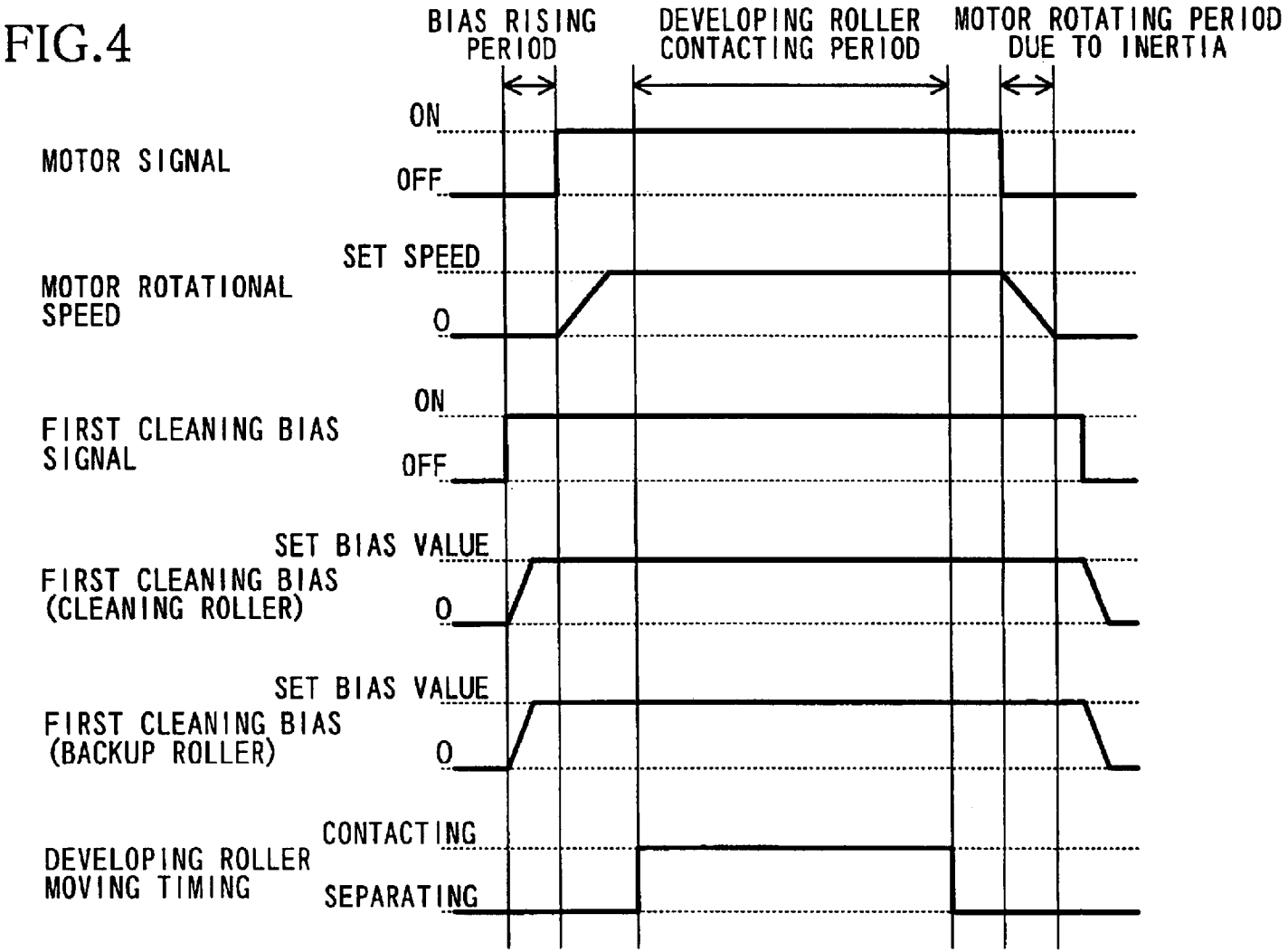
FIG. 4 is a timing chart showing the control of the cleaning operation shown in FIG. 3.

Referring to FIG. 4, the control executed by the drive control program will be described. When the image forming operation starts by which a power supply is turned on, the CPU 68 outputs a first cleaning bias signal. In response to this, the cleaning bias supply source 70 applies the first cleaning bias to the cleaning roller 41 and the backup roller 42.

The CPU 68 waits to output a motor signal until a bias rising period elapses after the CPU 68 starts outputting the first cleaning bias signal. The bias rising period is the time between the instant when the first cleaning bias is applied to the cleaning roller 41 and the backup roller 42 and the instant when the first cleaning biases, which are applied to the cleaning roller 41 and the backup roller 42, reach respective set bias values. In the embodiment, the bias rising period is approximately 0.5 seconds. The set bias values are −200 V for the cleaning roller 41 and −100 V for the backup roller 42.

After passage of the bias rising period, the CPU 68 outputs a motor signal. In response to the motor signal, the motor drive circuit 69 drives the motor 73, so that the cam 39 of the developing moving mechanism 34, the photosensitive drum 25, the cleaning roller 41, and the backup roller 42 are driven.

As described above, in accordance with the rotation of the photosensitive drum 25, the surface of the photosensitive drum 25 is uniformly positively charged by the charging device 26 and exposed to a laser beam emitted from the scanner unit 17. Thus, an electrostatic latent image is formed on the photosensitive drum 25 based on the image data. The cam 39 is driven so that the thin-walled portion 39*a* contacts the swing plate 38 and thus the developing roller 33 contacts the surface of the photosensitive drum 25. The electrostatic latent image formed on the photosensitive drum 25 is developed by toner. Thus, a visible toner image is formed on the surface of the photosensitive drum 25.

When the visible toner image formed on the surface of the photosensitive drum 25 faces and contacts the image transfer roller 27 as a result of the rotation of the photosensitive drum 25, the visible toner image is transferred onto the sheet 3 passing between the photosensitive drum 25 and the image transfer roller 27. After the development is complete, the cam 39 is driven so that the thick-walled portion 39*b* contacts the swing plate 38 and, thus, the developing roller 33 is separated from the photosensitive drum 25.

After that, when the CPU 68 stops outputting the motor signal, the motor drive circuit 69 also stops outputting the drive signal to the motor 73. However, the motor 73 does not immediately stop due to the inertia, so that the motor 73 rotates for approximately one second. Therefore, after a period of approximately one second, which is the period for the motor 73 to stop rotating, that is, after it is determined that the photosensitive drum 25 is standing completely still, the CPU 68 stops outputting the cleaning bias signal. In response to this, the cleaning bias supply source 70 stops applying the respective first cleaning biases to the cleaning roller 41 and the backup roller 42.

As described above, when the image forming operation starts, the motor 73 is driven after the bias rising period, which is the time between the instance when the cleaning bias supply source 70 is turned on and the instance when the first cleaning biases for the cleaning roller 41 and the backup roller 42 reach the respective set bias values, has elapsed. That is, after a time, which is required to positively establish a predetermined potential difference between the surfaces of the cleaning roller 41 and the photosensitive drum 25 by the first cleaning bias, has elapsed, the photosensitive drum 25 is driven.

Thus, the toner, which has been electrically captured and removed by the cleaning roller 41 at the previous image forming operation, can be effectively prevented from adhering to the photosensitive drum 25 at the start of the current image forming operation.

Likewise, the cleaning roller 41 and the backup roller 42 are driven after the first or second cleaning bias is applied thereto. Therefore, the toner, which has been captured and removed by the cleaning roller 41, is prevented from being conveyed to the paper dust storage portion 44.

At the time of ending the image forming operation, after the period during which the motor 73 rotates due to the inertia has elapsed, the cleaning bias supply source 70 is turned off and application of the first cleaning bias to the cleaning roller 41 is stopped.

The first cleaning bias applied to the cleaning roller 41 is turned off after the photosensitive drum 25 positively comes to a rest, so that the toner, which has adhered to the cleaning roller 41 until that moment, is effectively prevented from adhering to the photosensitive drum 25 when the image forming operation is finished.

Similarly, the first and second cleaning biases to the cleaning roller 41 and the backup roller 42 are turned off after the cleaning roller 41 and the backup roller 42 positively come to a rest. Accordingly, the toner, which has adhered to the cleaning roller 41, is also prevented from being conveyed to the paper dust storage portion 44.

On the other hand, as described above, when the second cleaning bias is applied to the cleaning roller 41 and the backup roller 42, paper dust, which was transferred from the sheet 3 and adheres to the photosensitive drum 25, is captured and removed by the cleaning roller 41 and then stored in the paper dust storage portion 44.

By executing the control as described above, contaminants, such as toner and paper dust, can be surely removed from the photosensitive drum 25 by the cleaning roller 41. Thus, the photosensitive drum 25 can be exposed to the laser beam and an image can be developed on the photosensitive drum 25 at the image forming operation, in an excellent condition. Accordingly, a high quality image can be formed.

In order to speed up the image forming speed, when the rotational speed of the motor 73 is set to a high speed, the motor 73 is apt to rotate due to the inertia even when the driving of the motor 73 is stopped in accordance with turning off of the motor signal. However, when the control is executed as the embodiment, the first cleaning bias is applied to the cleaning roller 41 while the motor 73 rotates due to the inertia, so that the toner, which has adhered to the cleaning roller 41, is not fed back to the photosensitive drum 25.

In the laser printer 1 of the embodiment, the total resistance value of both the internal impedance of the cleaning roller 41 and the cleaning bias supply source 70 is set to be $10^4$ Ω up to but not including $10^8$ Ω. Therefore, the first and second cleaning biases, which make the cleaning roller 41 and the backup roller 42 electrically capture and remove contaminants, such as toner and paper dust, remaining on the photosensitive drum 25, can be surely applied.

When the total resistance value is less than $10^4$ Ω, excessive current may be supplied to the photosensitive drum 25, which may damage the photosensitive drum 25. When the total resistance value is $10^8$ Ω or greater, there is a possibility that contaminants, such as toner and paper dust, may not be electrically captured and removed from the photosensitive drum 25.

The first cleaning bias of approximately −200 V to be applied to the cleaning roller 41 at the image forming operation is set such that the surface potential difference between the cleaning roller 41 and the photosensitive drum 25 after the transfer of the visible toner image onto the sheet 3, becomes approximately between 550 and 600 V, that is lower than the discharge starting voltage of the photosensitive drum 25.

Accordingly, even when the first cleaning bias is applied to the cleaning roller 41 in a state where the photosensitive drum 25 is standing still at the time of starting and finishing the image forming operation, discharge is not performed between the photosensitive drum 25 and the cleaning roller 41. Therefore, reliable operation is assured.

In the laser printer 1 of the embodiment, the developing roller 33 is moved to contact the photosensitive drum 25 when the developing operation is performed, and to separate from the photosensitive drum 25 when the developing operation is not performed, by the developing roller moving mechanism 34. Thus, the developing roller 33, toner and photosensitive drum 25 are prevented from being damaged by friction, as compared with a case where the developing roller 33 contacts the photosensitive drum 25 at all times. Accordingly, durability of the developing roller 33 and the photosensitive drum 25 are increased.

The developing roller 33 is brought into contact with the photosensitive drum 25 only when the developing operation is performed, while the developing roller 33 is out of contact with the photosensitive drum 25 immediately after the photosensitive drum 25 is driven or stopped. Accordingly, frictional resistance between the photosensitive drum 25 and the developing roller 33 is decreased. With this structure, the photosensitive drum 25 easily rotates immediately after the driving of the photosensitive drum 25 is started, and the photosensitive drum 25 is apt to rotate due to the inertia immediately after the driving of the photosensitive drum 25 is stopped even though the motor signal for the motor 73 is turned off.

However, when the control is executed as in the embodiment, the photosensitive drum 25 is only rotated after the first cleaning bias applied to the cleaning roller 41 reaches the set bias value. Further, the first cleaning bias is turned off after the period, in which the motor 73 rotates due to the inertia after the motor signal for the motor 73 is turned off, has elapsed.

That is, the first cleaning bias is applied to the cleaning roller 41 while the photosensitive drum 25 rotates, so that the toner, which adheres to the cleaning roller 41, does not adhere to the photosensitive drum 25 during that period.

A low-cost DC servo motor is used as the motor 73 so that the laser printer 1 can be structured at low cost. However, the DC servo motor is apt to rotate due to inertia as compared with a stepping motor.

However, when the control is executed as in the embodiment, even though the motor 73 rotates due to the inertia, the toner, which adheres to the cleaning roller 41, can be prevented from adhering to the photosensitive drum 25 because the first cleaning bias is applied to the cleaning roller 41 while the motor 73 rotates due to inertia.

The cleaning roller 41 rotates while a predetermined peripheral speed difference is maintained with respect to the rotational speed of the photosensitive drum 25. More specifically, the cleaning roller 41 rotates at a speed half as fast as the photosensitive drum 25. Therefore, a shearing force is generated between the cleaning roller 41 and the photosensitive drum 25 when the cleaning roller 41 rotates, so that contaminants, such as paper dust and toner, are electrically captured and removed from the photosensitive drum 25 by the cleaning roller 41 and physically wiped by the cleaning roller 41. Accordingly, the surface of the photosensitive drum 25 is excellently cleaned.

The toner, which is captured and removed by the cleaning roller 41, is fed back to the photosensitive drum 25, and then collected by the developing roller 33 for use during the next developing operation. Therefore, there is no need to provide a special member, such as a blade, that removes toner from the cleaning roller 41, or a large member for receiving and storing toner collected from the cleaning roller 41, thereby simplifying the structure of the laser printer 1.

If the toner is collected by the developing roller 33, paper dust, which adheres to the photosensitive drum 25, may be collected by the developing roller 33 with the toner. Then, impurities come to be mixed in the toner. This may cause deterioration of the image quality.

However, in the embodiment, paper dust, which adheres to the photosensitive drum 25, is captured and removed by the cleaning roller 41 at the time of collecting toner using the developing roller 33 and stored in the paper dust storage portion 44. That is, the toner remaining on the photosensitive member is charged positively and the paper dust on the photosensitive member is without charge. Thus, the toner will be collected onto the cleaning roller by the first cleaning bias of −200V because of its positive charge. The −200V bias is not enough to collect the non-charged paper dust from the photosensitive drum. The −200V bias is applied during at least one rotation of the photosensitive drum to collect the remaining toner. After the remaining toner is collected by the −200 bias, the second cleaning bias of +700V is applied to collect the paper dust from the photosensitive member. The +700V bias is enough to collect the paper dust. Accordingly, the above-described problem does not occur. Thus, the toner is easily collected and an image is formed in an excellent condition.

In the laser printer 1, a polymerized toner having excellent fluidity is used, so that a high quality image can be formed. Yet, the characteristic of the excellent fluidity makes it difficult to remove such polymerized toner using a wiping blade. In the embodiment, however, the polymerized toner is excellently and surely captured and removed from the photosensitive drum 25 by the potential difference that is established between the cleaning roller 41 and the photosensitive drum 25.

In the above-described embodiment, an explanation has been given where the cleaning roller 41 is used as an example of a conductive member that contacts the photosensitive drum 25. However, the conductive member is not limited to the above-described embodiment. A charging roller, a developing roller, an image transfer roller, or a cleaning brush can also be used as the conductive member.

As an example of the image holding member, the photosensitive drum 25 is used in the embodiment. However, the image holding member is also not limited to the embodiment, but an intermediate transfer medium, which is used in a color laser printer, can also be used.

Figure 5:
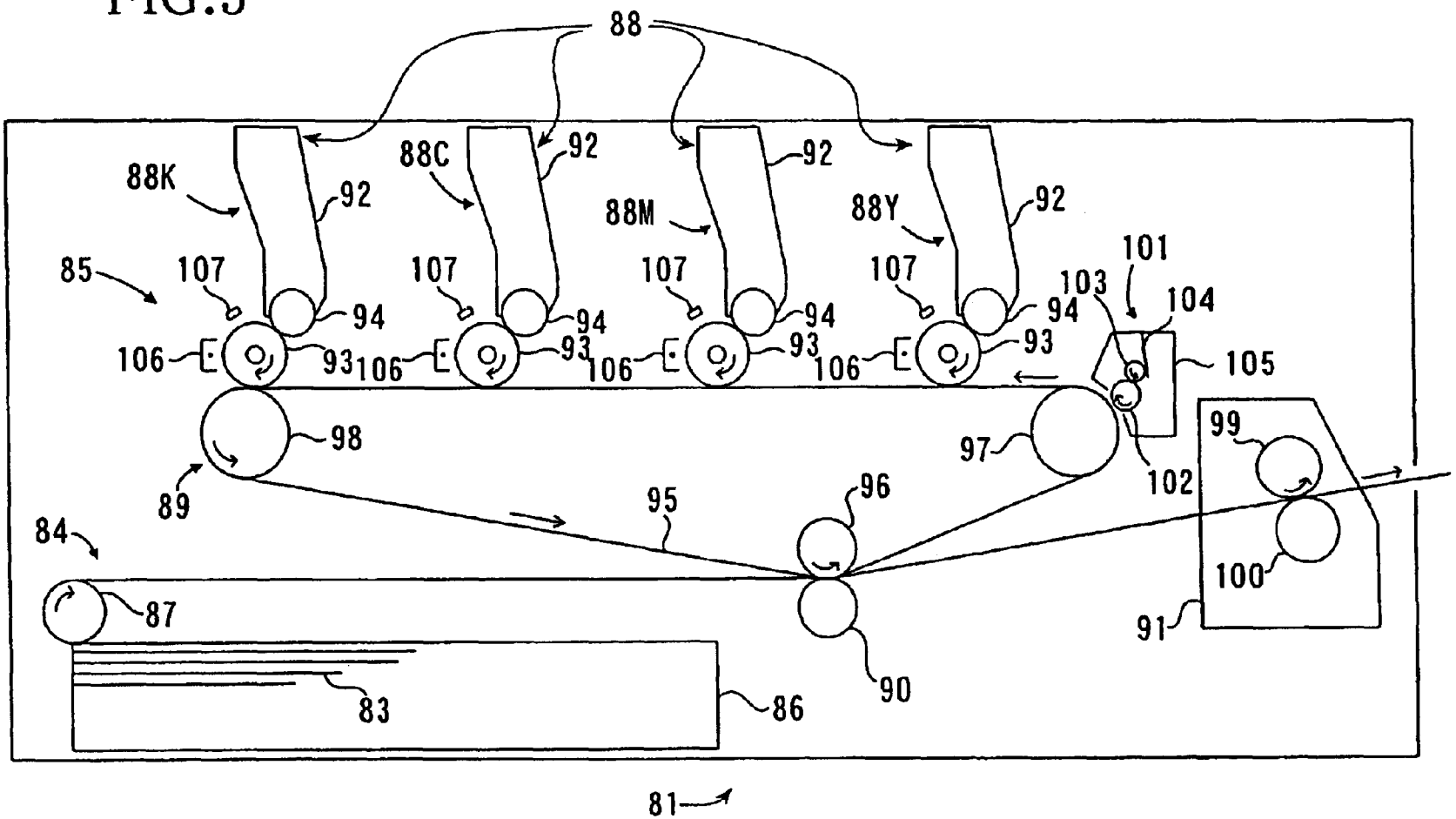
FIG. 5 is a cross-sectional view showing essential parts of a color laser printer.

FIG. 5 shows essential parts of a color laser printer 81 that includes an intermediate transfer medium. The color laser printer 81 includes a sheet feeding unit 84 that feeds a sheet 83 therefrom, and an image forming unit 85, that forms a predetermined image on the fed sheet 83, in a casing 82.

The sheet feeding unit 84 includes a sheet tray 86 and a pick-up roller 87. The sheet tray 86 contains a stack of sheets 83 therein. An uppermost sheet 83 in the sheet tray 86 is separated from the stack and fed to the image forming unit 85, one by one, by the pick-up roller 87.

The image forming unit 85 includes process units 88, an intermediate transfer mechanism 89, an image transfer roller 90, and a fixing unit 91.

The process units 88 are provided in an upper portion of the casing 82, and include a yellow developing process unit 88Y, a magenta developing process unit 88M, a cyan developing process unit 88C, and a black developing process unit 88K. The process units 88Y, 88M, 88C, 88K are aligned in parallel to each other, at a predetermined interval in a horizontal direction.

Each of the process units 88Y, 88M, 88C, 88K includes a process cartridge 92, a photosensitive drum 93, a scorotron charging device 106 and an LED array 107. All of the process units 88Y, 88M, 88C, 88K have the same structure, so that only one of the process units 88Y, 88M, 88C, 88K will be described below.

The process cartridge 92 includes a developing roller 94, a layer thickness-regulating blade (not shown), a toner supply roller (not shown) and a toner box (not shown). The process cartridges 92 each accommodate one color of a positively charging non-magnetic single component toner of one color of yellow, magenta, cyan, and black, respectively.

The toner supply roller is rotatably provided below the toner box. The developing roller 94 is rotatably disposed at a side below the toner supply roller. The toner supply roller includes a metal shaft covered with a conductive foam material. The developing roller 94 includes a metal shaft covered with a conductive elastic member. The toner supply roller and the developing roller 94 are in contact with each other while the toner supply roller and the developing roller 94 apply just the right amount of pressure to each other.

The layer thickness-regulating blade is disposed adjacent to the developing roller 94. The layer thickness-regulating blade includes a blade portion formed of a metal leaf spring and a contact portion attached to one end of the blade portion. The contact portion has a semicircular cross-sectional shape and is formed of insulating silicone rubber. The other end of the blade portion is supported near the developing roller 94 by the process cartridge 92. The contact portion presses the developing roller 94 with the elasticity of the leaf spring.

The toner discharged from the toner box is supplied onto the developing roller 94 by the rotation of the toner supply roller. The toner is positively charged through friction charging at the contact portion of the toner supply roller and the developing roller 94. As the developing roller 94 rotates, the toner supplied onto the developing roller 94 enters between the contact portion of the layer thickness-regulating blade and the developing roller 94 where the toner is again charged through friction charging, to obtain a sufficient charge. The toner, passing between the contact portion and the developing roller 94, is formed into a uniform-thickness, thin toner layer on the developing roller 94.

The photosensitive drum 93 is rotatably provided below the developing roller 94, to face the developing roller 94. The photosensitive drum 93 includes a main drum which is grounded. The surface of the photosensitive drum 93 is formed by a positively charging photosensitive layer including polycarbonate.

The scorotron charging device 106 is disposed at the side of the photosensitive drum 93 with a predetermined distance therebetween, to prevent the scorotron charging device 106 from contacting the photosensitive drum 93. The scorotron charging device 106 generates corona discharge from a charging wire made from tungsten or other appropriate material. The scorotron charging device 106 uniformly and positively charges the surface of the photosensitive drum 93.

The LED array 107 is disposed above the photosensitive drum 93, and includes a plurality of laser-emitting devices. A laser beam is emitted from the laser-emitting devices to scan the surface of the photosensitive drum 93 based on image data.

The surface of the photosensitive drum 93 is first positively, uniformly charged by the scrotron charging device 106, and then selectively exposed to the laser beam emitted from the LED array 107, thereby forming an electrostatic latent image thereon.

By the rotation of the developing roller 94 having the positively charged toner thereon, the toner is brought into contact with the photosensitive drum 93. The toner is supplied to the electrostatic latent image formed on the surface of the photosensitive drum 93, making the toner image visible.

The intermediate transfer mechanism 89 is provided under the photosensitive drums 93 so as to face the photosensitive drums 93. The intermediate transfer mechanism 89 includes three rollers, namely, a first roller 96, a second roller 97, and a third roller 98, which are disposed to form a triangle, and an intermediate transfer belt 95.

The first, second and third rollers 96, 97, 98 are disposed such that a line, extending between an upper point of the circumference of the second roller 97 and an upper point of the circumference of the third roller 98 in a horizontal direction, contacts lower surfaces of the photosensitive drums 93 and the first roller 96 is opposite to the image transfer roller 90.

The intermediate transfer belt 95 is wound around the first, second and third rollers 96, 97, 98. The intermediate transfer belt 95 can rotate in the counterclockwise direction while contacting the lower surfaces of the photosensitive drums 93 with a predetermined pressure, between the second roller 97 and the third roller 98.

The intermediate belt 95 is made of conductive resin, such as polycarbonate and polyimide, including conductive particles, such as carbon.

The visible toner images held on the respective photosensitive drums 93 face and contact the intermediate transfer belt 95, one after another, by rotation of the first, second and third rollers 96, 97, 98, so that the visible toner images are transferred onto the intermediate transfer belt 95 while overlaid one upon the other. Thus, a full-color image is formed on the intermediate transfer belt 95.

That is, first, an yellow visible toner image, which is formed on the photosensitive drum 93 using the yellow toner stored in the yellow developing process unit 88Y of the process cartridge 92, is transferred onto the intermediate transfer belt 95.

Next, a magenta visible toner image, which is formed on the photosensitive drum 93 using the magenta toner stored in the magenta developing process unit 88M of the process cartridge 92, is transferred onto the intermediate transfer belt 95 so as to be overlaid on the yellow visible toner image.

Likewise, a cyan visible toner image and a black visible toner image, which are formed on the respective photosensitive drums 93 using the cyan toner stored in the cyan developing process cartridge 88C and the black toner stored in the black developing process cartridge 88K, respectively, are transferred onto the intermediate transfer belt 95 so as to be overlaid on the former visible toner images on the intermediate transfer belt 95. By so doing, a color image is formed on the intermediate transfer belt 95.

The image transfer roller 90 is rotatably disposed below the first roller 96 and faces the first roller 96, sandwiching a sheet feeding path of the sheet 83. The image transfer roller 90 includes a metal shaft covered with a rubber material. A predetermined bias is applied to the image transfer roller 90.

The color image formed on the intermediate transfer belt 95 is transferred onto the sheet 83 while the sheet 83 passes between the intermediate transfer belt 95 and the image transfer roller 90.

The fixing unit 91 is provided downstream of the image transfer roller 90 in a sheet feeding direction of the sheet 83. The fixing unit 91 includes a heat roller 99, and an urging roller 100 that is urged against the heat roller 99.

The heat roller 99 includes a metal roller shaft coated by a roller portion formed of silicone rubber. The heat roller 99 has a halogen lamp therein for heating. The color image transferred onto the sheet 83 by the image transfer roller 90 is then fixed on the sheet 83 while the sheet 83 passes between the heat roller 99 and the urging roller 100. The sheet 83 having the fixed color image is ejected from the casing 82.

The color laser printer 81 includes a cleaning unit 101 that cleans the surface of the intermediate transfer belt 95 after the color image is transferred onto the sheet 83 from the intermediate transfer belt 95.

The cleaning unit 101 includes a cleaning roller 102, which is a conductive cleaning member, a backup roller 103, a wiping blade 104 and a waste toner storage portion 105.

The waste toner storage portion 105 is disposed downstream of the image transfer roller 90 and upstream of the process units 88, in the rotational direction of the intermediate transfer belt 95. The cleaning unit 101 faces the second roller 97, with the cleaning roller 102 of the cleaning unit 101, and the second roller 97 sandwiching the intermediate transfer belt 95 therebetween. The box-shaped waste toner storage portion 105 has an opening in a wall opposite to the intermediate transfer belt 95.

The cleaning roller 102 includes a metal roller shaft covered by a roller portion formed of an elastic foam material, such as silicone rubber. The cleaning roller 102 is supported at the opening so as to rotate in the clockwise direction with contacting the intermediate transfer belt 95.

The cleaning roller 102 is rotated by a motor (not shown) while a predetermined peripheral speed difference is maintained with respect to the rotational speed of the intermediate transfer belt 95. A cleaning bias is applied to the cleaning roller 102 by a cleaning bias supply source (not shown).

The backup roller 103 includes a metal roller shaft, and is supported in the waste toner storage portion 105 so as to rotate in the counterclockwise direction in contact with the cleaning roller 102. The backup roller 103 rotates at the same speed as the cleaning roller 102. A predetermined cleaning bias is applied to the cleaning bias supply source (not shown).

The wiping blade 104 is a thin plate member made of metal. The wiping blade 104 is supported in the waste toner storage portion 105 to wipe and remove toner adhering to the backup roller 103, with pressing the surface of the backup roller 103.

The toner, which remains on the surface of the intermediate transfer belt 95, after the color image is transferred onto the sheet 83 from the intermediate transfer belt 95, is electrically captured and removed by the cleaning roller 102 by the action of the cleaning bias applied to the cleaning roller 102.

When the toner captured by the cleaning roller 102 faces and contacts the backup roller 103, the toner is electrically captured and removed by the backup roller 103 by the action of the cleaning bias applied to the backup roller 103. When the toner captured by the backup roller 103 faces and contacts the wiping blade 104, the toner is wiped by the wiping blade 104 and stored in the waste toner storage portion 105.

In a manner similar to the laser printer 1, in the color laser printer 81, the cleaning bias is turned on before the intermediate transfer belt 95 is driven, and is turned off when or after the intermediate transfer belt 95 comes to rest.

The above control will be described in detail below. When an image forming operation starts by a drive control program by which a power is turned on, first, a CPU turns a cleaning bias signal on. In response to this, the cleaning bias supply source applies the cleaning bias to the cleaning roller 102 and the backup roller 103.

After turning the cleaning bias signal on, the CPU waits to turn on a motor signal until the cleaning biases applied to the cleaning roller 102 and the backup roller 103 reach respective set bias values.

After the period, which is required for the cleaning biases to reach the respective set bias values, has elapsed, the CPU outputs a motor signal. In response to the motor signal, a motor drive circuit drives the motor, so that the intermediate transfer belt 95, the cleaning roller 102 and the backup roller 103 are driven.

A color image is formed onto the intermediate transfer belt 95 by the series of image forming operations described above. After the complete color image is transferred onto the sheet 83 by the transfer roller 90, the CPU turns the motor signal off. Even though the motor drive circuit stops the drive of the motor, the motor does not immediately stop due to the inertia, so that the motor rotates for a while.

Therefore, after it is determined that the rotation of the motor due to the inertia is stopped and the intermediate transfer belt 95 is standing completely standing still, the CPU turns the cleaning bias signal off. In response to this, the cleaning bias supply source stops applying the first cleaning bias to the cleaning roller 102 and the backup roller 103.

When the control is executed as described above, the photosensitive drum 93 is driven after a predetermined potential difference is surely established between the cleaning roller 102 and the intermediate transfer belt 95 at the start of the image forming operation. Thus, the toner, which has been electrically captured and removed by the cleaning roller 102 at the previous image forming operation, can be effectively prevented from adhering to the intermediate transfer belt 95 at the start of the current image forming operation.

At the time of ending the image forming operation, after the intermediate transfer belt 95 surely comes to rest, the cleaning bias for the cleaning roller 102 is turned off. Accordingly, the toner, which has adhered to the cleaning roller 41 until that moment, is effectively prevented from adhering to the intermediate transfer belt 95 when the image forming operation is finished. As a result, the toner, which remains on the intermediate transfer belt 95, can be surely removed, so that a high quality color image can be formed on the intermediate transfer belt 95.

While the invention has been described in detail and with reference to the specific embodiments thereof, it would be apparent to those skilled in the art that various changes, arrangements and modifications may be applied thereto without departing from the spirit and scope of the invention.

What is claimed is:

1. An image forming apparatus, comprising:

an image holding element that holds an image formed by a developer, the image holding element being driven to move;

a cleaning roller that contacts the image holding element, the cleaning roller being driven to move;

a backup roller that contacts the cleaning roller, the backup roller being driven to move;

a biasing device that selectively applies to the cleaning roller a first electric bias allowing the developer and a paper dust on the image holding element to move to the cleaning roller and a second electric bias allowing the developer on the cleaning roller to move to the image holding element and allowing the paper dust on the cleaning roller to move to the backup roller; and a controller that controls the biasing device such that one of the first electric bias and the second electric bias is applied to the cleaning roller before all of the image holding element, cleaning roller, and the backup roller are driven to move.

2. The image forming apparatus according to claim 1, wherein the controller controls the image holding element to be driven when or after the one of the first electric bias and the second electric bias becomes a predetermined value.

3. The image forming apparatus according to claim 1, wherein the controller controls the image holding element to be driven when or after a predetermined time has elapsed after the application of the one of the first electric bias and the second electric bias.

4. The image forming apparatus according to claim 1, wherein the image holding element is a photosensitive member, on which an electrostatic latent image is formed, the electrostatic latent image made visible with the developer.

5. The image forming apparatus according to claim 4, further comprising a developer cartridge that contains a developing roller and the developer therein, wherein the developer cartridge is movable such that the developing roller separates from and contacts the photosensitive member.

6. The image forming apparatus according to claim 1, wherein a range of impedance of the cleaning roller and the biasing device is not less than $10^4$ Ω and less is than $10^8$ Ω.

7. The image forming apparatus according to claim 1, wherein the image holding element is an intermediate transfer medium on which each of a plurality of colors of the image is transferred successively.

8. The image forming apparatus according to claim 1, wherein the cleaning roller is driven to move such that a moving velocity of the cleaning roller is different from a moving velocity of the image holding element.

9. The image forming apparatus according to claim 1, wherein the electric potential difference is not enough to cause an electric discharge between the image holding element and the cleaning roller.

10. An image forming apparatus, comprising:

an image holding element that holds an image formed by a developer, the image holding element being driven to move;

a cleaning roller that contacts the image holding element, the cleaning roller being driven to move;

a backup roller that contacts the contacts the cleaning roller, the backup roller being driven to move;

a biasing device that selectively applies to the cleaning roller a first electric bias allowing the developer and a paper dust on the image holding element to move to the cleaning roller and a second electric bias allowing the developer on the cleaning roller to move to the image holding element and allowing the paper dust on the cleaning roller to move to the backup roller; and a controller that controls the biasing device such that one of the first electric bias and the second electric bias that is applied to the cleaning roller is discontinued when or after all of the image holding element, cleaning roller, and the backup roller stop stops moving.

11. The image forming apparatus according to claim 10, wherein the controller controls the biasing device to discontinue applying the electric bias when or after a predetermined time has elapsed after the image holding element stops being driven.

12. The image forming apparatus according to claim 10, wherein the image holding element is a photosensitive member, on which an electrostatic latent image is formed, the electrostatic latent image being made visible with the developer.

13. The image forming apparatus according to claim 12, further comprising a developer cartridge that contains a developing roller and the developer therein, wherein the developer cartridge is movable such that the developing roller separates from and contacts the photosensitive member.

14. The image forming apparatus according to claim 10, wherein a range of impedance of the cleaning roller and the biasing device is not less than $10^4$ Ω and is less than $10^8$ Ω.

15. The image forming apparatus according to claim 10, wherein the image holding element is an intermediate transfer medium on which each of a plurality of colors of the image is transferred successively.

16. The image forming apparatus according to claim 10, wherein the cleaning roller is driven to move such that a moving velocity of the cleaning roller is different from a moving velocity of the image holding element.

17. The image forming apparatus according to claim 16, wherein the electric potential difference is not enough to cause an electric discharge between the image holding element and the cleaning roller.

18. An image forming apparatus, comprising:

an image holding element that holds an image formed by a developer, the image holding element being driven to move;

a cleaning roller that contacts the image holding element, the cleaning roller being driven to move;

a backup that contacts the cleaning roller, the backup roller being driven to move;

a biasing device that selectively applies to the cleaning roller a first electric bias allowing the developer and a paper dust on the image holding element to move to the cleaning roller and a second electric bias allowing the develop on the cleaning roller to move to the image holding element and allowing the paper dust on the cleaning roller to move to the backup roller; and a controller that controls the biasing device such that one of the first electric bias and the second electric bias is applied to the cleaning roller before all of the image holding element, cleaning roller, and the backup roller are driven to move and is discontinued when or after the image holding element, cleaning roller, and the backup roller stop moving.

* * * * *